US005366069A

United States Patent [19]

Seidner

[11] Patent Number: 5,366,069

[45] Date of Patent: Nov. 22, 1994

[54] MODULAR COIN STORAGE ASSEMBLY

[76] Inventor: Mark W. Seidner, 9602 N. 121st Pl., Scottsdale, Ariz. 85259

[21] Appl. No.: 139,458

[22] Filed: Oct. 20, 1993

Related U.S. Application Data

[63] Continuation of Ser. No. 904,460, Jun. 26, 1992, abandoned.

[51] Int. Cl.[5] ..... A45C 1/00; B65D 85/62

[52] U.S. Cl. ..... 206/0.84; 206/499; 220/410; 220/507; 220/23.83; 220/526

[58] Field of Search ..... 206/0.8, 0.81, 0.82, 206/0.83, 0.84, 315.11, 499, 505; 220/408, 410, 412, 413, 507, 516, 526, 528, 529, 527, 543, 544, 545, 546, 550, 553, 555, 575, 23.83, 23.86

[56] References Cited

U.S. PATENT DOCUMENTS

| | | | |
|---|---|---|---|
| 1,349,527 | 8/1920 | Owen | 220/23.93 |
| 2,944,694 | 7/1960 | Kinsey | 220/23.83 |
| 3,241,706 | 3/1966 | Monaco et al. | 220/408 X |
| 3,484,035 | 12/1969 | Swett et al. | 220/555 X |
| 3,589,554 | 6/1971 | Smith | 220/23.83 |
| 4,593,819 | 6/1986 | Will | 206/538 |
| 4,595,113 | 6/1986 | Fafflok et al. | 220/23.83 |
| 4,735,318 | 4/1988 | Keffeler | 206/532 |
| 5,027,972 | 7/1991 | Bartholomew | 220/526 |
| 5,118,173 | 6/1992 | Proctor et al. | 220/410 X |

*Primary Examiner*—Jacob K. Ackun, Jr.
*Attorney, Agent, or Firm*—Richard R. Mybeck

[57] ABSTRACT

A modular coin storage assembly having a cover and a base member and a plurality of inter changeable species-specific rack members suspendible therein for substantially dust proof rattle free storage. Each rack member provides a plurality of coin holder compartments disposed in one or two files therealong. When enclosed, the cover member circumscribes the base member and secures the rack members relative thereto.

10 Claims, 4 Drawing Sheets

FIG. 6A (CENTS)

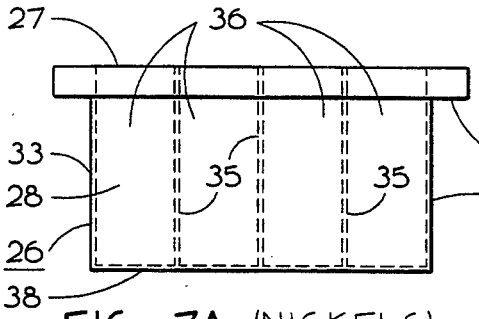
FIG. 7A (NICKELS)
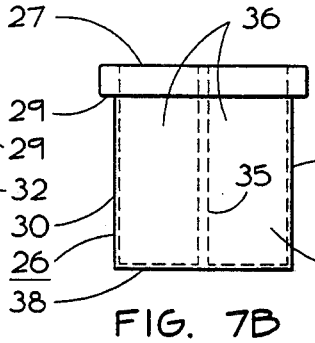
FIG. 7B
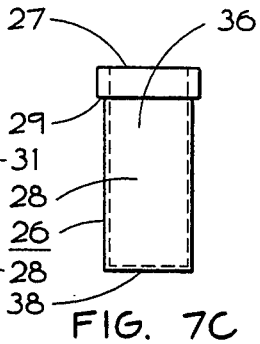
FIG. 7C
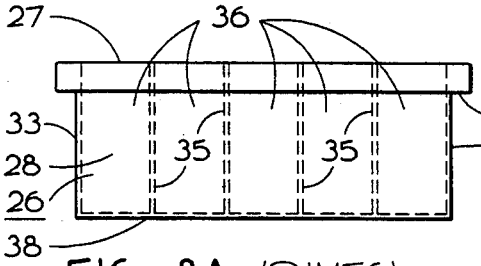
FIG. 8A (DIMES)
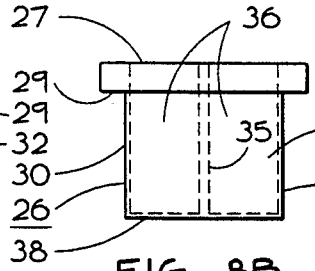
FIG. 8B
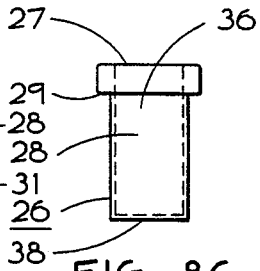
FIG. 8C
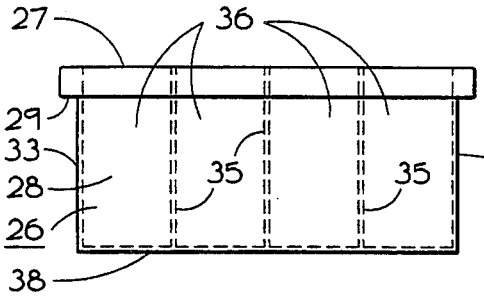
FIG. 9A (QUARTERS)
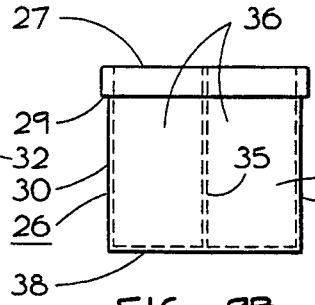
FIG. 9B
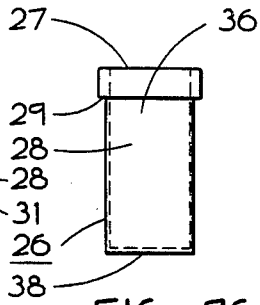
FIG. 9C
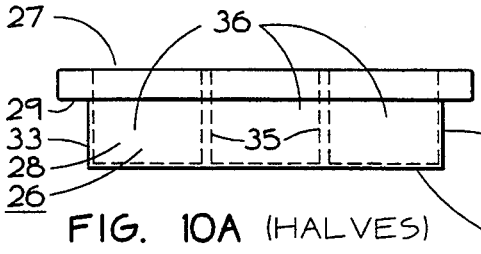
FIG. 10A (HALVES)
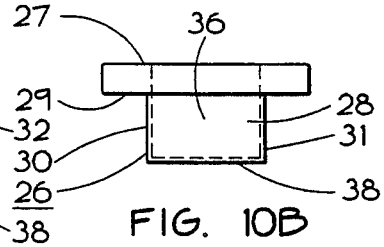
FIG. 10B
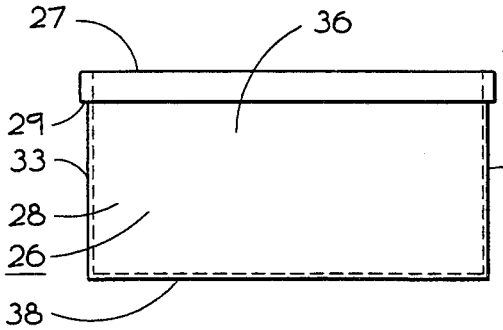
FIG. 11 (PROOF SETS)
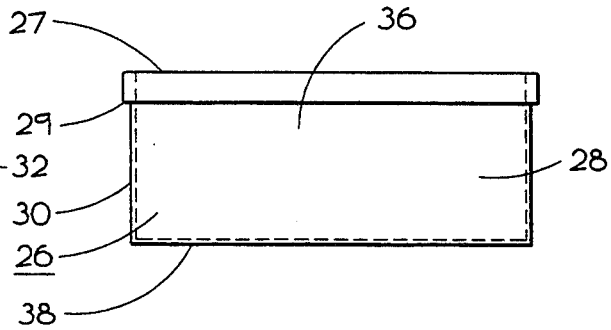
FIG. 12 (2X2 HOLDERS)

MODULAR COIN STORAGE ASSEMBLY

This is a continuation application from pending U.S. patent application Ser. No. 07/904,460 filed on Jun. 26, 1992 for "MODULAR COIN STORAGE ASSEMBLY", now abandoned.

INTRODUCTION

This invention relates generally to means and methods of readily storing numismatic items, and more particularly to a modular coin storage assembly in which a variety of coins, proof sets and other collectible species may be safely maintained within a common container.

BACKGROUND OF THE INVENTION

The collection of coins is an ever expanding avocation. However, once coins have been acquired, they must be stored, preferably, in a systematic manner. However, this storage problem is not as simple as may be believed.

For example, every denomination of American coins are of different diameter and thickness. The same is true of many foreign coins. Each individual numismatist has a primary interest in collecting a particular denomination and type of coin, with a secondary and tertiary interest in the other denominations and types. Many coin collections today are kept loose in jars or in coin albums or in bank coin wrappers or they may be stored in one of the many plastic tubes currently available at numismatic specialty shops. An ideal storage apparatus should accommodate the storage of many collectibles, in addition to the tubes, such as U.S. proof and mint sets, regardless of the manner in which such items are individually stored.

To date, no numismatic storage system has been developed which will accommodate a wide variety of individual collection containers, partly because the storage of a wide variety of coins into a singular system has not attracted a great deal of attention, but more particularly because the prior art that exists does not provide any system which possesses the requisite degree of flexibility for multi-specie accumulation and storage.

Accordingly, it is towards the solution of this problem that the subject invention is directed.

SUMMARY OF THE INVENTION

The present invention comprises a universal and interchangeable coin storage system comprising a generally rectangular housing base member having an inner flange surface disposed on the internal wall thereof and adapted to suspend one or more modular racks therefrom between opposite flanges. Each modular rack comprises a plurality of compartments (usually 4) which are defined between a first and second end wall and an intermediate first and second side wall. The compartments are enclosed at the bottom and open at the tops. Each end member has an outreaching flange extending therefrom and engageable with for support by the inner flange of the housing member. Each modular rack is provided with a depth such that a standard coin tube when seated therein will extend upwardly from the upper plane of the rack a distance sufficient to enable the collector to readily grasp an individual coin tube and place it into or remove it from a given compartment without touching the rack. The modular racks which are provided are specifically designed for coin holders currently available for each denomination of coin in circulation including tubes and set holders.

When the desired number of racks and tubes are in place, a complementing cover member is disposed upon the housing base member in covering dust-free circumscription thereabout to complete the unit for storage.

Accordingly, a primary object of the subject invention is to create a modular coin storage system which will interchangeably accept a plurality of coin storage modules and which will store coins and sets in a clean, safe and secure manner.

Another object of the subject invention is to create a coin storage system comprising a plurality of interchangeable modular rack members within a specially designed housing member wherein each rack has a plurality of compartments sized to permit specific coin holders to set therein and protrude uniformly therefrom.

A still further object of the present invention is to provide a novel and unique numismatic storage system in which interchangeable modular racks are disposed within a common housing member, each rack having a plurality of compartments defined therein to permit an idiosyncratic coin holder to set therein and protrude therefrom.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

BRIEF DESCRIPTION OF THE DRAWINGS

In the drawings:

FIG. 6A, is an isometric view of a modular storage unit embodying the present invention which is specifically configured for two files of compartments defined for United States one cent pieces;

FIG. 7A, is a side elevation of another modular storage unit embodying the present invention which is specifically configured for storing United States five cent pieces;

FIG. 7B, is an end elevation of the storage unit of FIG. 7A provided with two files of coin holder compartments;

FIG. 7C, is an end elevation of the storage unit of FIG. 7A provided with a single file of coin holder compartments;

FIG. 8A, is a side elevation of a modular storage unit embodying the present invention which is specifically configured for storing United States ten cent pieces;

FIG. 8B, is an end elevation of the storage unit of FIG. 8A provided with two files of coin holder compartments;

FIG. 8C, is an end elevation of the storage unit of FIG. 8A provided with a single file of coin holder compartments;

FIG. 9A, is a side elevation of a modular storage unit embodying the present invention which is specifically configured for storing United States twenty-five cent pieces;

FIG. 9B, is an end elevation of the storage unit of FIG. 9A;

FIG. 9C, is an end elevation of the storage unit of FIG. 9A provided with a single file of coin holder compartments;

FIG. 10A, is a side elevation of a modular storage unit embodying the present invention which is specifically configured for storing United States fifty cent pieces;

FIG. 10B, is an end elevation of the storage unit of FIG. 10A provided with a single file of coin holder compartments;

FIG. 11 is a side elevation of a modular storage unit embodying the present invention customized for storing United States Mint proof sets; and FIG. 12 is a side elevation of a storage unit embodying the present invention customized for storing 2×2 mounts and 2×2 plastic holders.

DESCRIPTION OF THE PREFERRED EMBODIMENT

Figure 1:
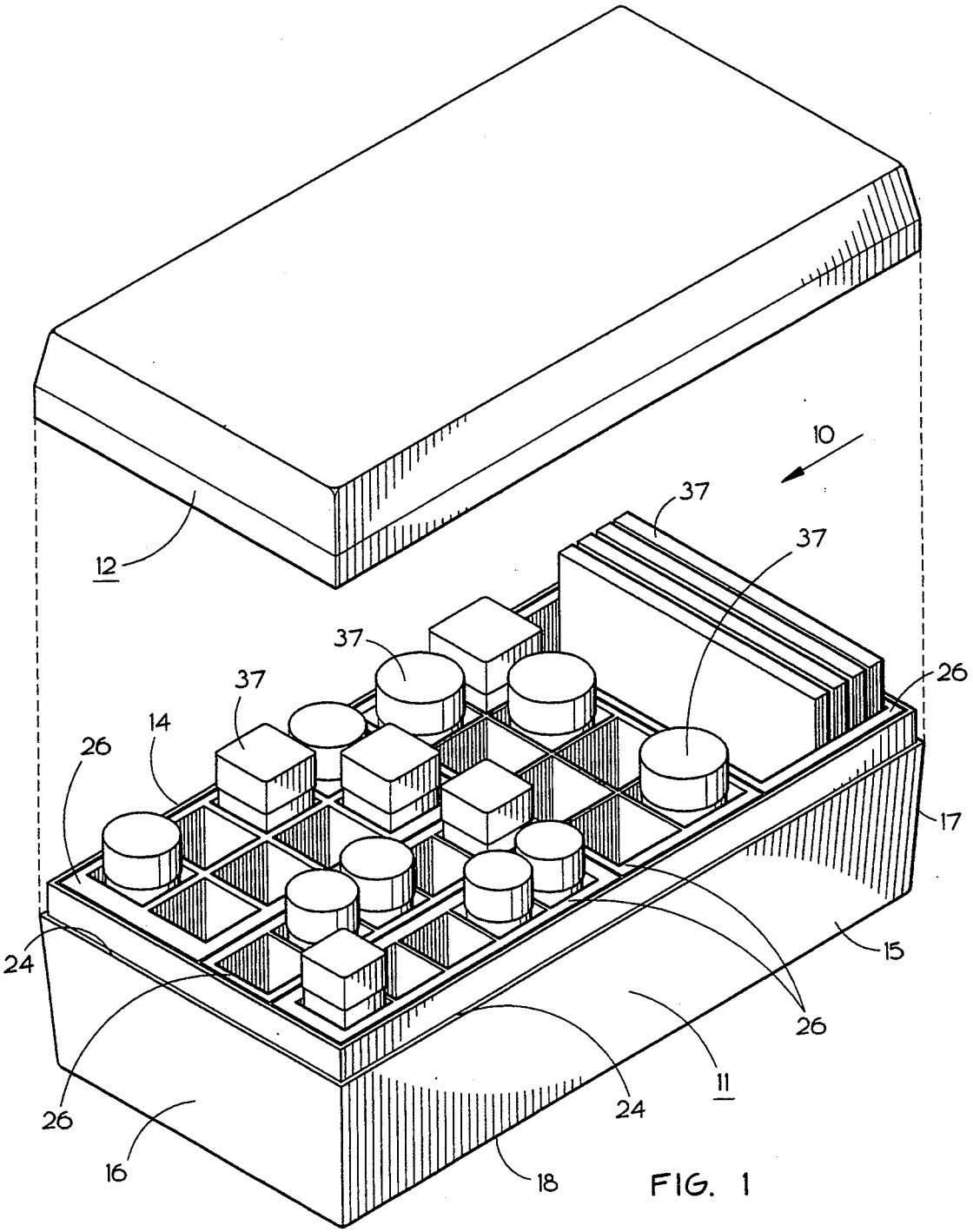
FIG. 1, is an isometric exploded view of a numismatic storage assembly embodying the present invention.

Referring to the drawing in which the numismatic storage assembly of the present invention is identified throughout by the general reference numeral 10, the assembly 10 comprises a base member 11 and a cover 12. The base member 11 defines a generally rectangular storage area 13 between a pair of side walls 14, 15 disposed in generally parallel spaced relationship to each other and joined by spaced end walls 16, 17 integrally formed therewith in orthogonal relationship thereto. Side walls 14, 15 and end walls 16, 17 are seated upon a bottom wall 18 and extend upwardly therefrom to define main storage area 13.

The inner surface of side walls 14, 15 and end walls 16, 17 are each provided with an inwardly extending continuous ledge 20 disposed in circumscription about storage area 13 in fixed spaced relationship to bottom wall 18 and operative in a manner to be hereinafter described in detail.

A tranverse partition member 21 is disposed and extends between side walls 14, 15 in spaced parallel relationship to end walls 16, 17 to divide main storage area 13 into two identical sub-areas 22, 23.

Figure 4:
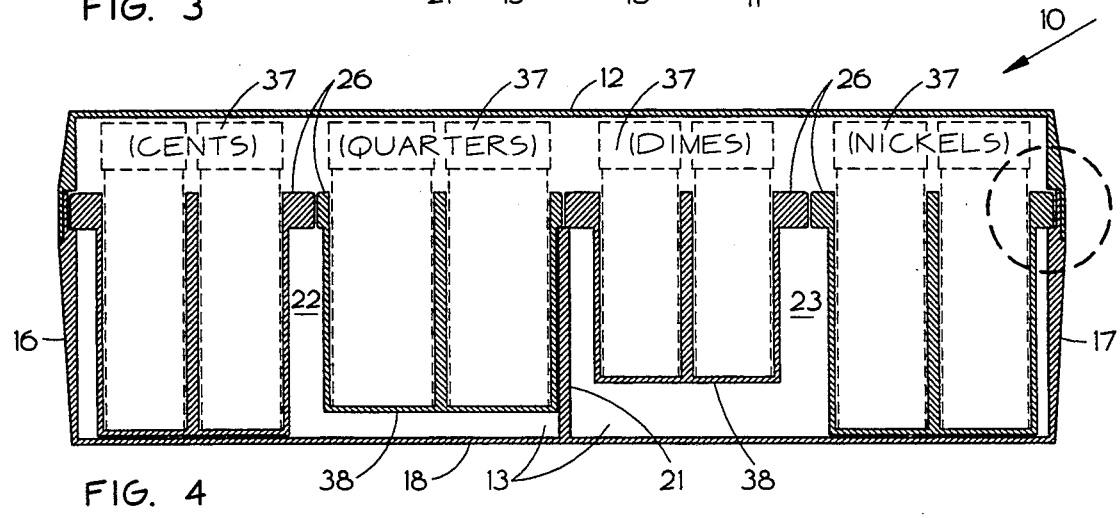
FIG. 4, is a cross-sectional view taken on the longitudinal center line of the storage assembly of FIG. 3 showing an alternative arrangement of diverse modular storage units disposed there.
Figure 5:
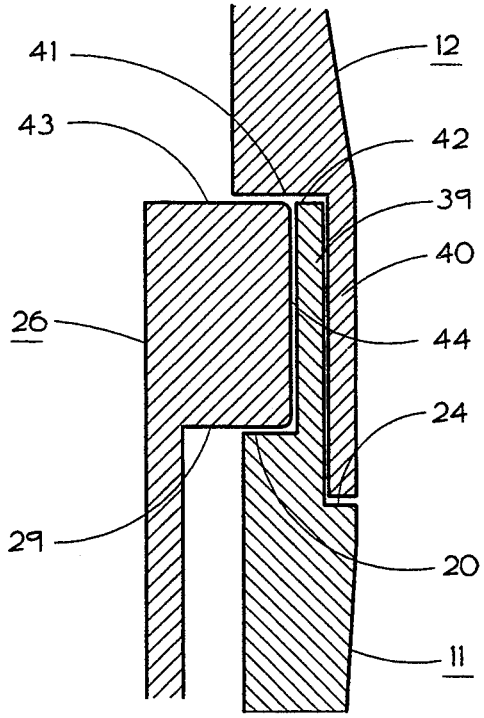
FIG. 5, is an enlarged view of circular section of FIG. 4.
Figure 6B:
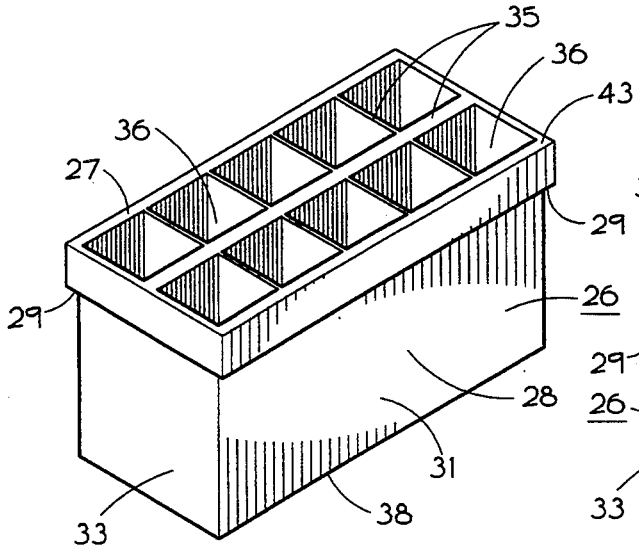
FIG. 6B, is an isometric view of a modular storage unit embodying the present invention which is specifically configured for a single file of coin holder compartments.
Figure 6B:
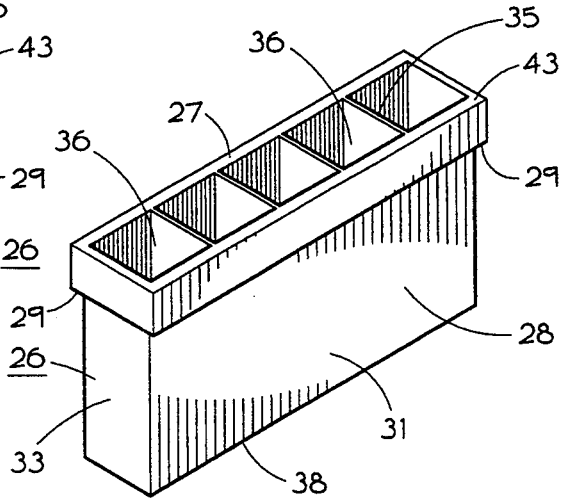

As shown in FIGS. 4 and 5, base member 11 is further provided on the outer perimeter thereof with an external ledge 24 in circumscription thereabout for coaction with cover 12 to provide a tight substantially dust-free interface therewith when cover 12 is placed upon base member 11 to complete assembly 10.

A plurality of diverse storage devices identified by the general reference 26, each of which is interchangeable with every other device will now be described. As will appear, each device possesses special properties which adapt it to receive and hold the specific numismatic item it is designed to hold while possessing certain common properties which enable it to function so beautifully in the storage assembly.

Referring particularly to FIGS. 1, 2, 4 and 5, each rack 26 comprises an upper portion 27 and a depending lower portion 28. Upper portion 27 includes an over reaching perimeter flange portion 29 configured so that rack 26 is suspended by the engagement of the flange 29 with ledge 20 and, when appropriate, partition 21. As is apparent in the preferred practice of this invention, subareas 22, 23 define a square and will accommodate and suspend rack 26 regardless of whether rack is disposed therein longitudinally of base member 11, as shown in sub area 22 of FIG. 2, or transversely therein, as shown in sub area 23 of FIG. 2 and in FIG. 4.

A typical rack 26 comprises first side wall 30, a second side wall 31, a first end wall 32 and a second end wall 33 which define a rectangular frame or body portion 34 which is normally subdivided into four or five "ranks" and one or two "files" depending upon the size and the quantity of the coins to be stored.

A plurality of uniform cross-members 35 are interposed between side walls 30,31 intermediate end walls 32, 33 and in spaced parallel relationship to those end walls 32,33 to define a plurality of compartments 36 for receiving individual coin holders 37 herein.

Each compartment 36 is closed at its bottom by a bottom plate 38 which is preferably common to all of the compartments in a given rack 26. The depth of each rack is customized so that when a conventional coin holder 37 is placed therein, approximately $\frac{3}{4}''$ of its height will protrude above the upper plane of the rack 26 to enable each holder to be discretely gripped and removed from the rack. As shown in FIG. 4, the depth of the various coin holders, compartments 36 such as, those shown customized for cents, quarters, dimes and nickels will vary in accordance with the size of the conventional coin holder 37 which in turn is dictated by the thickness of the respective coin to be stored therein, and the number of such coins normally held in such a container eg, 50, 20, 25 and the like. The common sizing of such coin holders is already well known to the numismatist and need not be further elaborated here. Each rack 26 is specifically designed to support a single denomination coin.

Special attention should be directed to FIGS. 4 and 5 wherein the special dust-free coaction between base member 11 and cover 12 is shown. As previously described, base member 11 is provided with an internal ledge 20 on the internal perimeter thereof and upon which the perimeter flange 29 of rack member 26 is supported in depending relationship therefrom to support the rack member in storage area 13. Base member 11 is also provided with an external ledge 24 on the perimeter thereof and flange portion 39 extends upwardly therefrom between internal ledge 20 external ledge 24 for surface-to-surface planar engagement with the internal surface of flange portion 40 which extends downward from cover 12 and totally circumscribes flange portion 39 of base member 11 when in fully closed position.

Thus disposed, the lower edge 41 of cover 12 overlays the upper end 42 of flange portion 39 and upper surface 43 of rack 26 to essentially seal the storage chamber 13 and to lock the individual racks 26 in place and prevent any vertical movement of the racks 26 when the assembly is closed.

In the production of the base member 11, the cover 12 and the various racks 26, it has been found both convenient and practical to injection mold the various members using conventional injection molding equipment and polystyrene or Mylar as the materials of choice. Of course, other materials which provide a similar combination of strength and resiliency may be employed so long as they are chemically inert relative to the coins being stored. One material to be avoided is polyvinylchloride which has a history of reacting with coin metal to discolor the coins and substantially diminish their value as a collectible.

In use, a rack 26, having preselected depth adapted for the particular coin to be stored, is placed in base member 11 with flange portion 29 resting upon adjacent portion of ledge 20 and, when appropriate, the upper surface of portion 21. A number of different racks 26 can be selected to any desired homogenous or heterogenous combination of coin holders 37 within a base 11. Each rack 26 has a special depth so that the selected coin holder 37 when seated in a compartment 36, will extend above top plane of the rack 26 a sufficient distance to permit it to be readily gripped for removal from rack 26 without disturbing any other holder.

Figure 2:
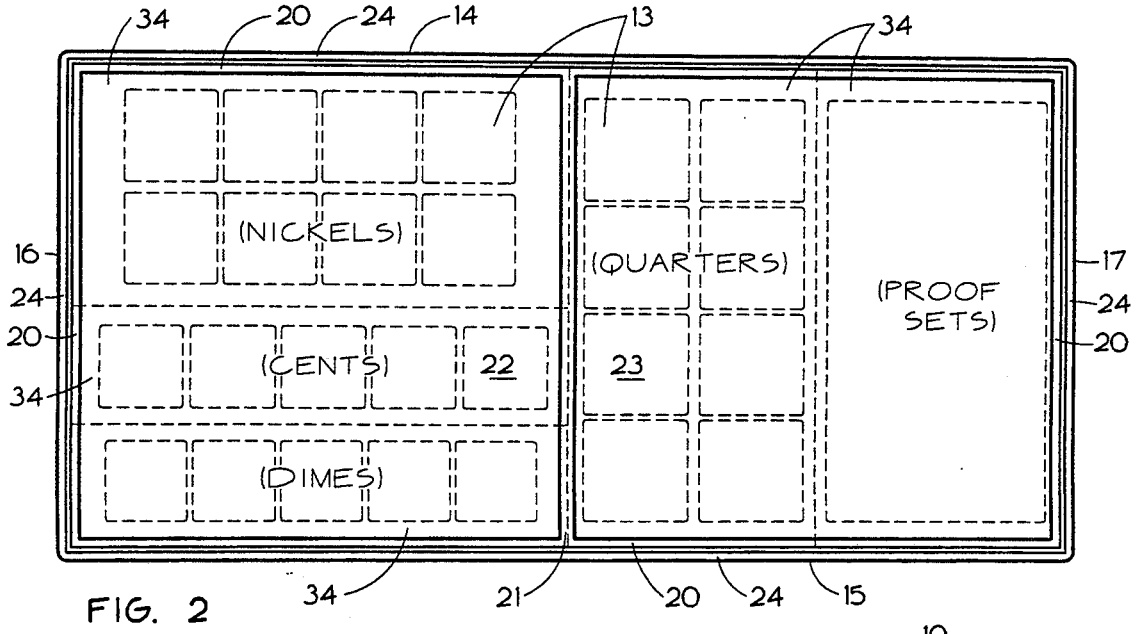
FIG. 2, is a plan view of the storage assembly of FIG. 1 having one arrangement of diverse modular storage units disposed therein.
Figure 3:
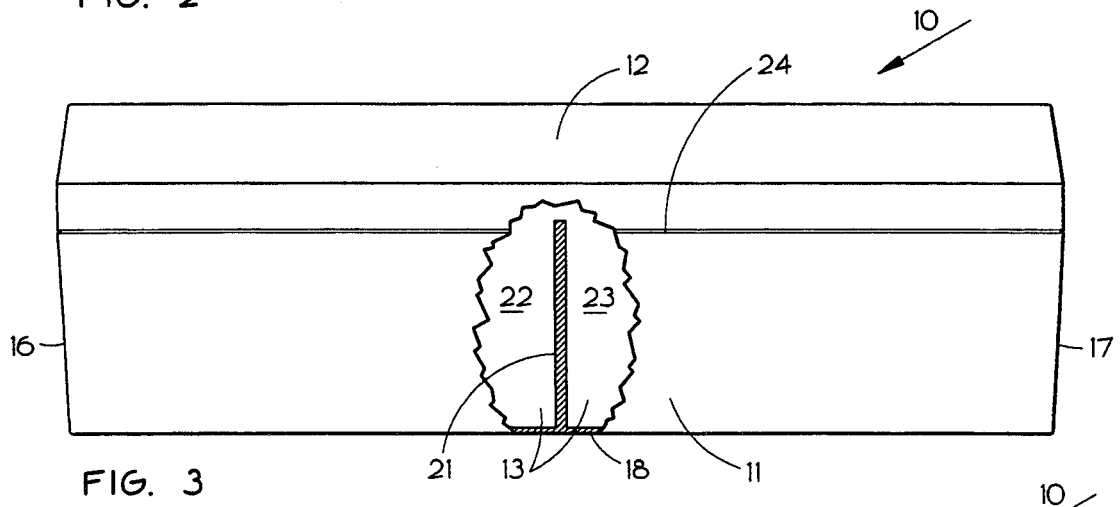
FIG. 3, is a side elevation partially broken away, of the storage assembly of FIG. 1 when closed for storage.

When the desired assortment of the modular storage units or racks 26 has been chosen and placed within the respective sub areas 22,23 with flange 29 resting upon internal ledge 20 of base member 11 and, when appropriate, portion 21, it being noted that each sub area 22,23 define a square so that racks may be mounted either axially or transversely, as shown in FIGS. 1 and 2 or all transversely as shown in FIG. 4, cover 12 is then disposed onto base member 11 so that flange 39 engages flange 40 is dust free surface-to-surface engagement therewith on one surface thereof and external surface 44 of rack 26 on the other surface thereof. The surface 41 of cover 12 rests snugly upon surface 42 of flange portion 39 and surface 43 of rack 26 thereby rendering it essentially impossible for unwanted dust to migrate into storage area 13 when the cover 12 is thus disposed.

From the foregoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A modular coin storage system comprising: a plurality of discrete coin holders; a base member; a plurality of modular racks, each having a plurality of discrete coin-holder receiving compartments defined thereby of preselected section and depth to conform to the size of one of said coin-holders to be stored therewithin; means for suspending said modular racks within said base member; and means for covering said base member in interlocking engagement therewith to prevent the passage of dust thereinto while simultaneously securing said modular racks from movement relative thereto.

2. A modular coin storage system according to claim 1 in which said means for covering said base member has a flange member extending downwardly therefrom into sealing circumscription about said base member, said flange member having a lower inwardly extending surface for simultaneously engaging said base member, said modular racks, and said coin holders contained therein to prevent any movement therebetween.

3. A modular coin storage system comprising: a plurality of discrete coin holders; a base member with a detachable cover, said base member having a bottom wall having a rectangular perimeter, a pair of spaced generally parallel side walls seated upon said base member and extending perpendicularly upwardly from said perimeter, and a pair of spaced generally parallel end walls seated upon said base member and extending perpendicularly upwardly from said perimeter in connecting relationship with said side walls to define a rectangular storage area therewithin, said storage area having an inwardly extending continuous ledge circumscribed thereabout in fixed spaced relationship to said bottom wall; and a plurality of interchangeable racks mountable in said storage area, each of said racks having a rectangular body portion which, when mounted in said storage area, is disposed in substantially parallel relationship to said side walls and said end walls and each of said interchangeable racks also having an outreaching flange portion on the perimeter thereof, said flange portion having an upper surface and a lower surface, said lower surface configured to engage said inwardly extending ledge of said storage area to suspend said body portion therefrom, said upper surface disposed to engage said detachable cover in surface-to-surface relationship therewith, said body portion of said rack having a plurality of vertically disposed compartments defined therein, each of said compartments dimensioned to secure one of said coin holders therewithin.

4. A modular coin storage system according to claim 3 in which said compartments are disposed in a single file.

5. A modular coin storage system according to claim 3 in which said compartments are disposed in a double file.

6. A modular coin storage system according to claim 3 having a transverse portion extending thereacross between said side walls in equi-spaced parallel relationship to said end walls to divide said storage area into two identical subareas.

7. A modular coin storage system according to claim 6 in which each said subarea is square in plan section.

8. A modular coin storage system comprising: a plurality of discrete coin holders; a base member defining a generally rectangular storage container having a storage area defined by a bottom wall, generally parallel side walls and generally parallel end walls, said side walls being joined to said end walls and integrally formed therewith in orthogonal relationship thereto, said bottom wall being joined to said side walls and said end walls and integrally formed therewith in orthogonal relationship thereto, each of said side walls and said end walls having an inwardly extending ledge portion defined thereupon in fixed spaced relationship to said bottom wall to define a support surface and having an outwardly extending ledge portion defined thereupon, said base member further having a transverse partition extending upwardly from said bottom wall to the plane of said support surface between said side walls in equi-spaced parallel relationship to said end walls to divide said storage area into two identical subareas; a plurality of removable rectangular racks, each mountable in one of said subareas and having a body portion and an outwardly extending flange portion on the upper perimeter thereof, said body portion having two generally parallel side walls, two generally parallel end walls, and a bottom wall, said side walls being joined to said end walls and integrally formed therewith in orthogonal relationship thereto, said bottom wall being joined to said side walls and said end walls and integrally formed therewith in orthogonal relationship thereto, each said rack having a plurality of uniform cross members interposed between said side walls and said end walls to define a plurality of compartments therewithin, each said compartment dimensioned to hold one of said coin holders therein, said flange portion of each said rack engaging at least two of said inwardly extending ledge portions or engaging at least one of said inwardly extending ledge portions and said transverse partition to suspend said rack therefrom; a cover member having a top wall, a pair of generally parallel side walls, and a pair of generally parallel end walls each disposed in generally perpendicular relationship to said top wall and integrally formed therewith and with each other, each of said side walls and each of said end walls having an inwardly extending flange portion on the perimeter thereof for operative engagement with said outwardly extending ledge portion of said base member to prevent the passage of dust into said storage area when said cover member is seated upon said base member.

9. A modular coin storage system according to claim 8 in which each said compartment in each said rack is dimensioned to receive therein one of said plurality of discrete coin holders of a preselected size corresponding to any of a plurality of denominations of coins predetermined to be held therein.

10. A modular coin storage system according to claim 9 in which said cover engages said coin holders when said cover seated upon said base member.

* * * * *